US007574750B2

(12) United States Patent
Harris

(10) Patent No.: US 7,574,750 B2
(45) Date of Patent: Aug. 18, 2009

(54) COMBINATION SNOWSUIT AND CARRIER FOR BABY/INFANT

(76) Inventor: Joani C. Harris, 4043 Warner Ave., Landover Hills, MD (US) 20784

( * ) Notice: Subject to any disclaimer, the term of this patent is extended or adjusted under 35 U.S.C. 154(b) by 0 days.

(21) Appl. No.: 11/808,005

(22) Filed: Jun. 5, 2007

(65) Prior Publication Data

US 2007/0283480 A1 Dec. 13, 2007

Related U.S. Application Data

(60) Provisional application No. 60/811,426, filed on Jun. 7, 2006.

(51) Int. Cl.
*A41D 11/00* (2006.01)
*A41B 13/06* (2006.01)

(52) U.S. Cl. ..... 2/80; 2/69.5

(58) Field of Classification Search ..... 2/80, 2/69, 456, 79, 84, 94, 227, 300, 308, 309, 2/310, 311, 312, 915, 914, 458, 67, 69.5; 224/158, 159, 160, 576
See application file for complete search history.

(56) References Cited

U.S. PATENT DOCUMENTS

| | | | | |
|---|---|---|---|---|
| 1,292,351 | A | 1/1919 | Milkes | |
| 1,973,421 | A | 9/1934 | Wallace | |
| D132,469 | S | 5/1942 | Murphy | |
| 2,425,635 | A | 8/1947 | Nitzberg | |
| 2,483,344 | A | 9/1949 | Kessner | |
| 2,505,239 | A | 4/1950 | Goldstein | |
| 2,615,165 | A * | 10/1952 | Steedman | 2/80 |
| 3,100,897 | A | 8/1963 | Langer | |
| 3,575,326 | A * | 4/1971 | Chappell | 224/159 |
| 4,308,629 | A * | 1/1982 | Freemon | 441/111 |
| 4,333,591 | A | 6/1982 | Case | |
| 4,606,078 | A | 8/1986 | Tkacsik | |
| 4,625,335 | A | 12/1986 | Vinai | |
| 4,771,479 | A | 9/1988 | Silver | |
| 4,773,101 | A | 9/1988 | Kapp et al. | |
| 5,023,952 | A | 6/1991 | Palmer | |
| 5,131,096 | A | 7/1992 | Olson | |

(Continued)

FOREIGN PATENT DOCUMENTS

| | | |
|---|---|---|
| FR | 2650487 | 2/1991 |

(Continued)

*Primary Examiner*—Gary L. Welch
*Assistant Examiner*—Amber R Anderson
(74) *Attorney, Agent, or Firm*—Richard C. Litman

(57) ABSTRACT

The combination snowsuit and carrier for a baby or infant is configured to be worn by a wearer and includes a body support structure, a one-piece coverall garment, and a harness. The body support structure is configured to support the body of the infant and includes a front support, a back support, a pair of side supports, and a seat support for supporting the bottom of the infant. The coverall garment is configured to receive the body of the infant and has a main body portion, a pair of arm sleeves, a pair of legs, and a hood. The main body portion of the garment is integral with the body support structure. The harness is used for connecting the combination snowsuit and carrier to the wearer, is attached to the body support structure, and includes a waist belt and a pair of shoulder straps.

9 Claims, 5 Drawing Sheets

U.S. PATENT DOCUMENTS

| | | | | |
|---|---|---|---|---|
| D362,742 | S | 10/1995 | Bergman | |
| 5,542,123 | A | 8/1996 | DiPietro | |
| D385,688 | S | 11/1997 | Clausell | |
| 5,791,535 | A * | 8/1998 | Roan et al. | 224/160 |
| D414,032 | S * | 9/1999 | Howell | D3/213 |
| 6,216,269 | B1 | 4/2001 | Smith et al. | |
| 6,283,347 | B1 * | 9/2001 | Roh | 224/160 |
| 6,408,439 | B1 | 6/2002 | Garforth-Crippen | |
| 6,666,361 | B1 | 12/2003 | Lin | |
| 6,763,983 | B2 * | 7/2004 | Norman | 224/160 |
| 6,817,033 | B2 | 11/2004 | Bailey | |
| 6,836,902 | B2 | 1/2005 | Marquez et al. | |
| 2005/0045674 | A1 | 3/2005 | Rehbein | |
| 2005/0060789 | A1 | 3/2005 | Waldman | |
| 2005/0217004 | A1 | 10/2005 | Haberfeld | |
| 2005/0218168 | A1 | 10/2005 | Chua | |

FOREIGN PATENT DOCUMENTS

| | | | |
|---|---|---|---|
| GB | 2084861 | | 4/1982 |
| JP | 09-094136 | * | 4/1997 |
| JP | 2004337593 | | 12/2004 |

* cited by examiner

COMBINATION SNOWSUIT AND CARRIER FOR BABY/INFANT

CROSS-REFERENCE TO RELATED APPLICATION

This application claims the benefit of U.S. Provisional Patent Application Ser. No. 60/811,426, filed Jun. 7, 2006.

BACKGROUND OF THE INVENTION

1. Field of the Invention

The present invention relates to baby and infant carriers, and more specifically to a combination snowsuit and carrier for a baby or infant that can be worn by the person carrying the baby or infant.

2. Description of the Related Art

Baby and infant carriers are well known and are commonly used by parents and other caretakers to easily transport infants. Many of the most popular of these carriers are designed to be worn by the parent in such a way that it reduces the amount of physical exertion required to hold and carry the infant for extended periods of time. Commonly, these carriers have some sort of infant support frame for holding the infant in the carrier, along with a series of straps for securing the carrier to the wearer. However, such carriers typically have the disadvantage that, during cold and wet weather, the infant is substantially unprotected from the elements. Should the infant be dressed in cold weather clothing, such as a snowsuit, for example, it is often difficult to fit the bundled child into such carriers. Further, many of these carriers do not provide storage compartments having sufficient room for carrying various items such as bottles, diapers, etc., which typically must be transported with an infant.

It would be desirable to provide a combination snowsuit and carrier for an infant that allows the infant to be fully protected from the elements, while still providing an efficient way for a parent to secure the carrier to his or her body for easy holding and transportation of the infant. Thus, a combination snowsuit and carrier for a baby/infant solving the aforementioned problems is desired.

SUMMARY OF THE INVENTION

The combination snowsuit and carrier for a baby or infant is configured to be worn by a wearer and includes a body support structure, a one-piece coverall garment, and a harness. The body support structure is configured to support the body of the infant and includes a front support, a back support, a pair of side supports, and a seat support for supporting the bottom of the infant. The seat support has two openings for accommodating the legs of the infant.

The one-piece coverall garment is configured to receive the body of the infant and has a main body portion, a pair of arm sleeves, a pair of legs, and a hood. The main body portion of the garment is integral with the body support structure so that the entire combination snowsuit and carrier is a one-piece item. The harness is used for connecting the combination snowsuit and carrier to the wearer, is attached to the body support structure, and includes a waist belt and a pair of shoulder straps. These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
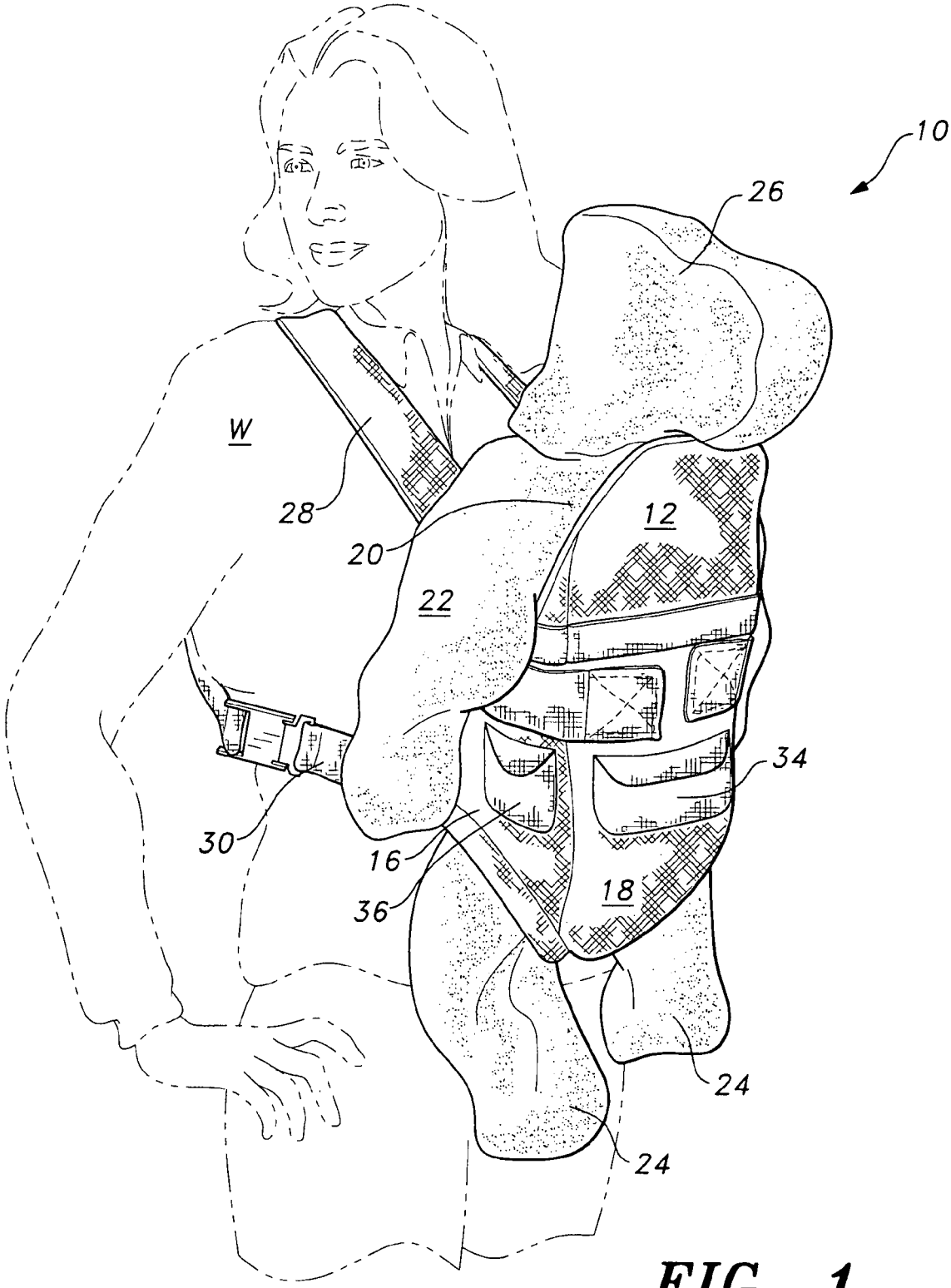
FIG. 1 is an environmental, perspective view of a combination snowsuit and carrier for baby/infant-according to the present invention.
Figure 2:
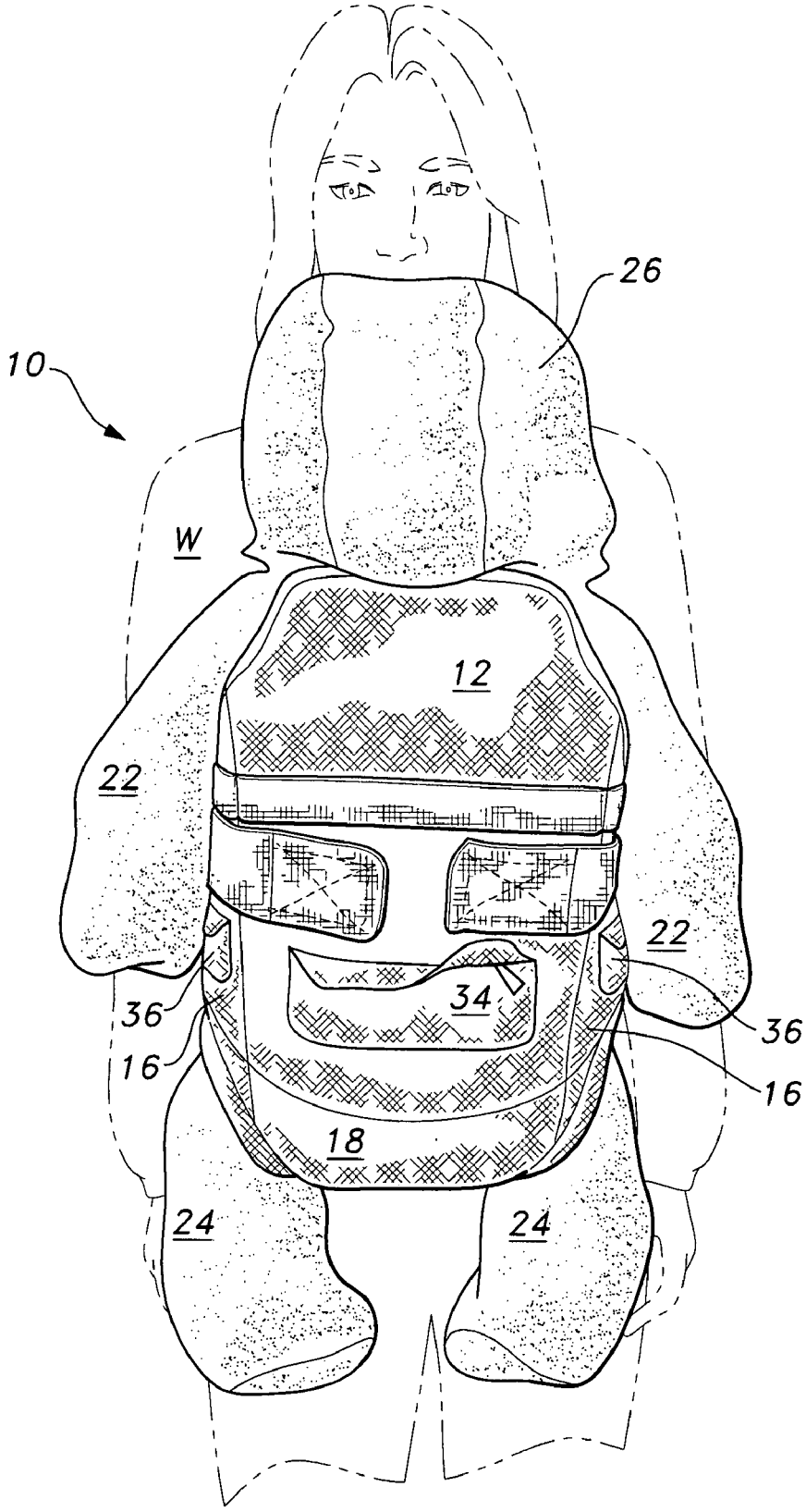
FIG. 2 is a environmental view of a combination snowsuit and carrier for baby/infant according to the present invention, showing the person using the carrier from the front, the snowsuit and carrier being seen from the rear.
Figure 3:
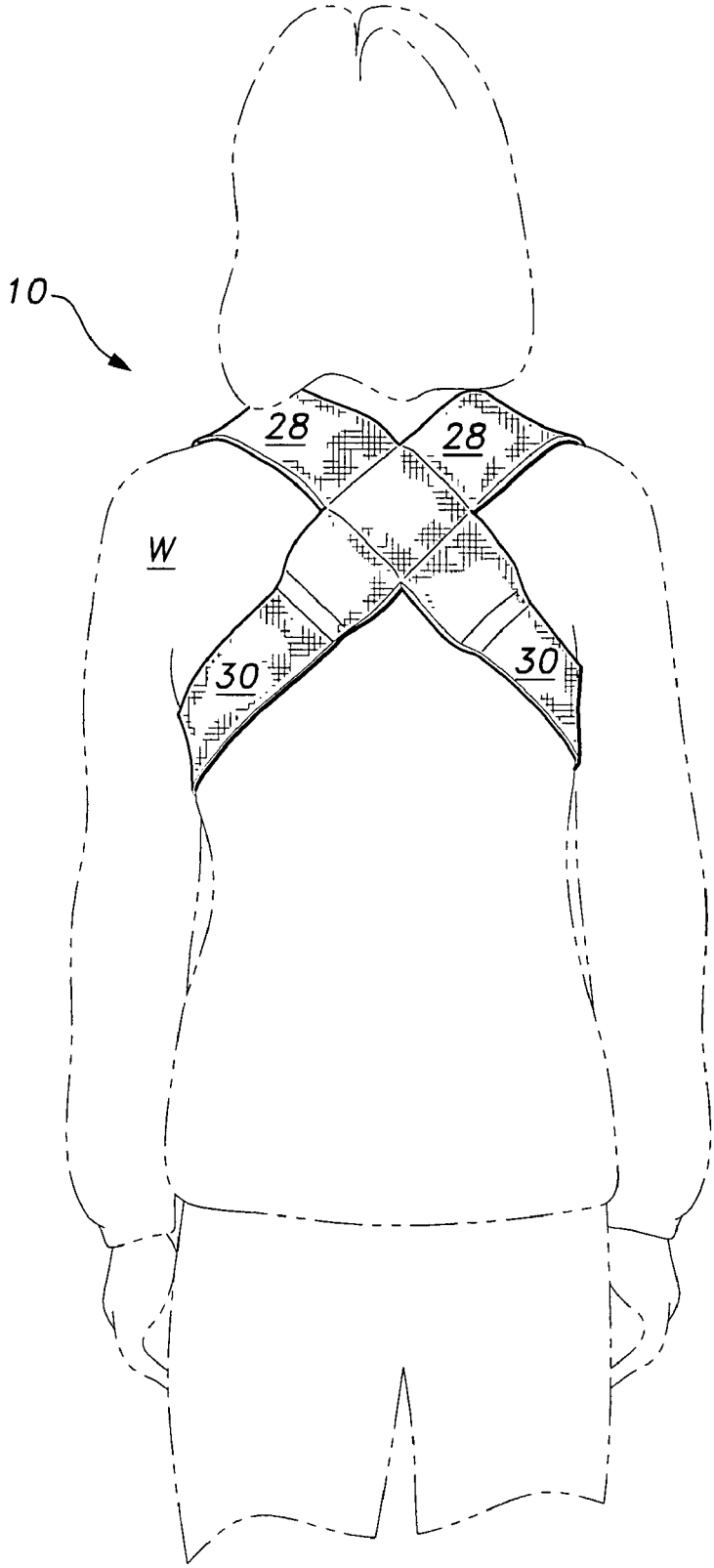
FIG. 3 is an environmental view of a combination snowsuit and carrier for baby/infant according to the present invention, showing the person using the carrier from the rear, the harness straps of the carrier being visible.
Figure 4:
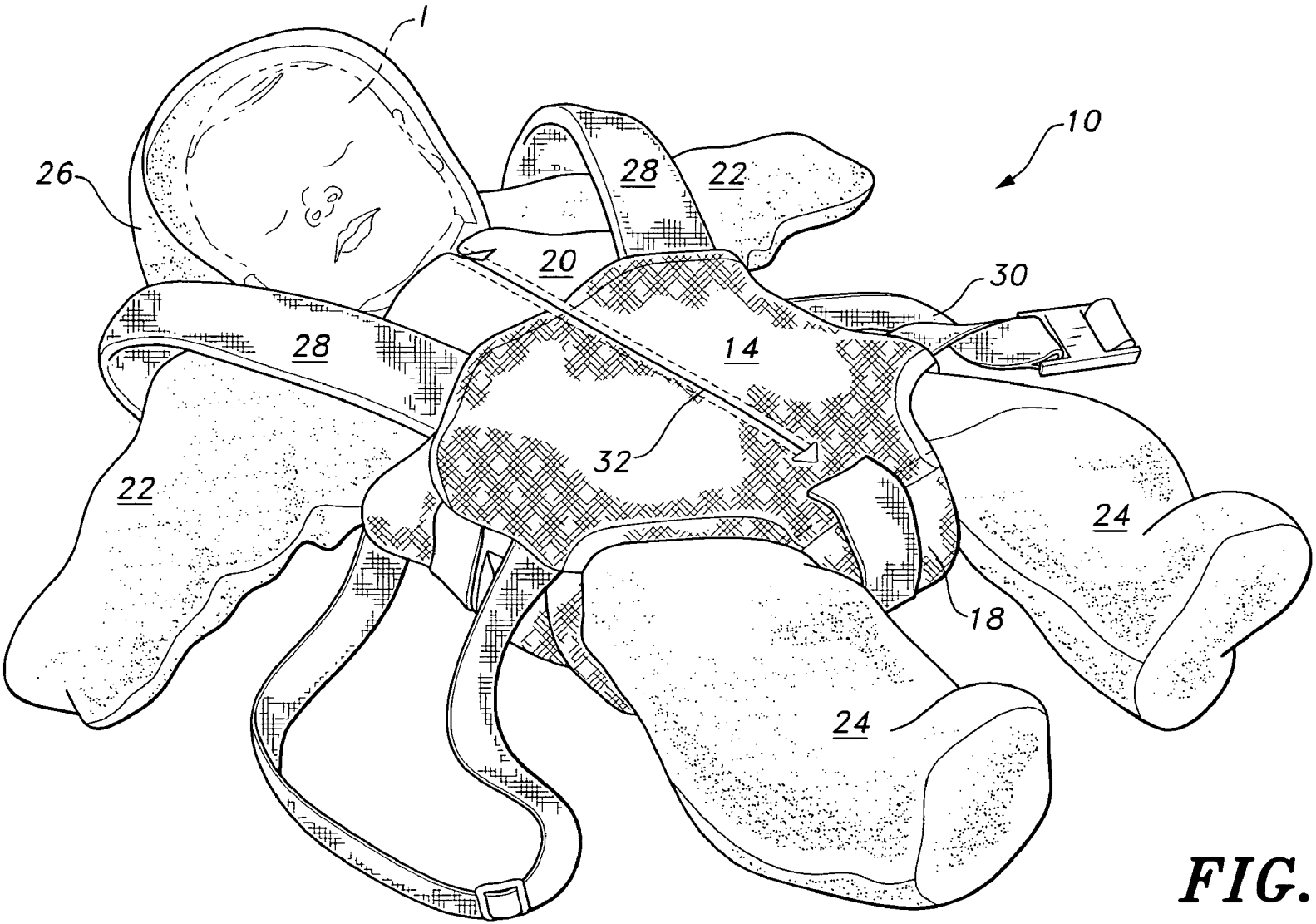
FIG. 4 is a perspective view of a combination snowsuit and carrier for baby/infant according to the present invention as seen from the front.

The present invention is a combination snowsuit and carrier for a baby/infant, which is configured to be worn by a wearer, of which the preferred embodiment is designated generally as 10 in the drawings.

Referring to FIGS. 1-4, the combination snowsuit and carrier 10 is designed for protecting and carrying an infant I while being worn by a wearer W, and includes a body support structure, a one-piece coverall garment, and a harness. The body support structure is configured to support the body of an infant and includes a front support 14 (best shown in FIG. 4), a back support 12 (best shown in FIGS. 1 and 2), a pair of side supports 16, and a seat support 18 for supporting the bottom of the infant. Seat support 18 has two openings formed therethrough for accommodating the legs of the infant I. The body support structure is configured to support the weight of the infant I while infant I is contained within the combination snowsuit and carrier 10.

The body support structure is further provided with a series of pockets, which may be used to hold necessary infant-related accessories, such as bottles, diapers, etc. A larger rear pocket 34 is provided along back support 12 of the body support structure, and a pair of smaller side pockets 36 are disposed along each of the side supports 16 of the body support structure.

The one-piece coverall garment is configured to receive the body of the infant and includes a main body portion 20, a pair of arm sleeves 22, a pair of legs 24, and a hood 26. The coverall garment may include suitable thermal insulation and be made from water-resistant (and, preferably, machine-washable) fabric in conventional fashion, forming a snowsuit. Preferably, main body portion 20 is integral with the body support structure so that combination snowsuit and carrier 10 is a one-piece, unitary body. A zipper 32 is preferably disposed along the front side of combination snowsuit and carrier 10 and acts to open and close the integrated main body portion 20 of the garment and the front support 14 of the body support structure. It should be understood that zipper 32 may be replaced with any suitable releasable fastener, such as snap fasteners or the like. In this manner, an infant I can be easily inserted into, and removed from, combination snowsuit and carrier 10, with the coverall garment acting to protect the infant from inclement weather conditions.

The harness is provided for connecting combination snowsuit and carrier 10 to the wearer, is attached to the body support structure, and includes a waist belt 30 and a pair of shoulder straps 28. Shoulder straps 28 and waist belt 30 are attached to the body support structure so that when combination snowsuit and carrier 10 is worn by the wearer W, the infant I is positioned face-to-face with the wearer W. The waist belt 30 may be formed by first portions extending from the body support structure and second portions extending from ends of the shoulder straps 28 that are joined together behind the wearer's shoulders, the first and second portions being releasably attached to each other by buckles on opposite sides of the wearer's torso, the buckles permitting adjustment of the length to the waist belt 30.

Figure 5:
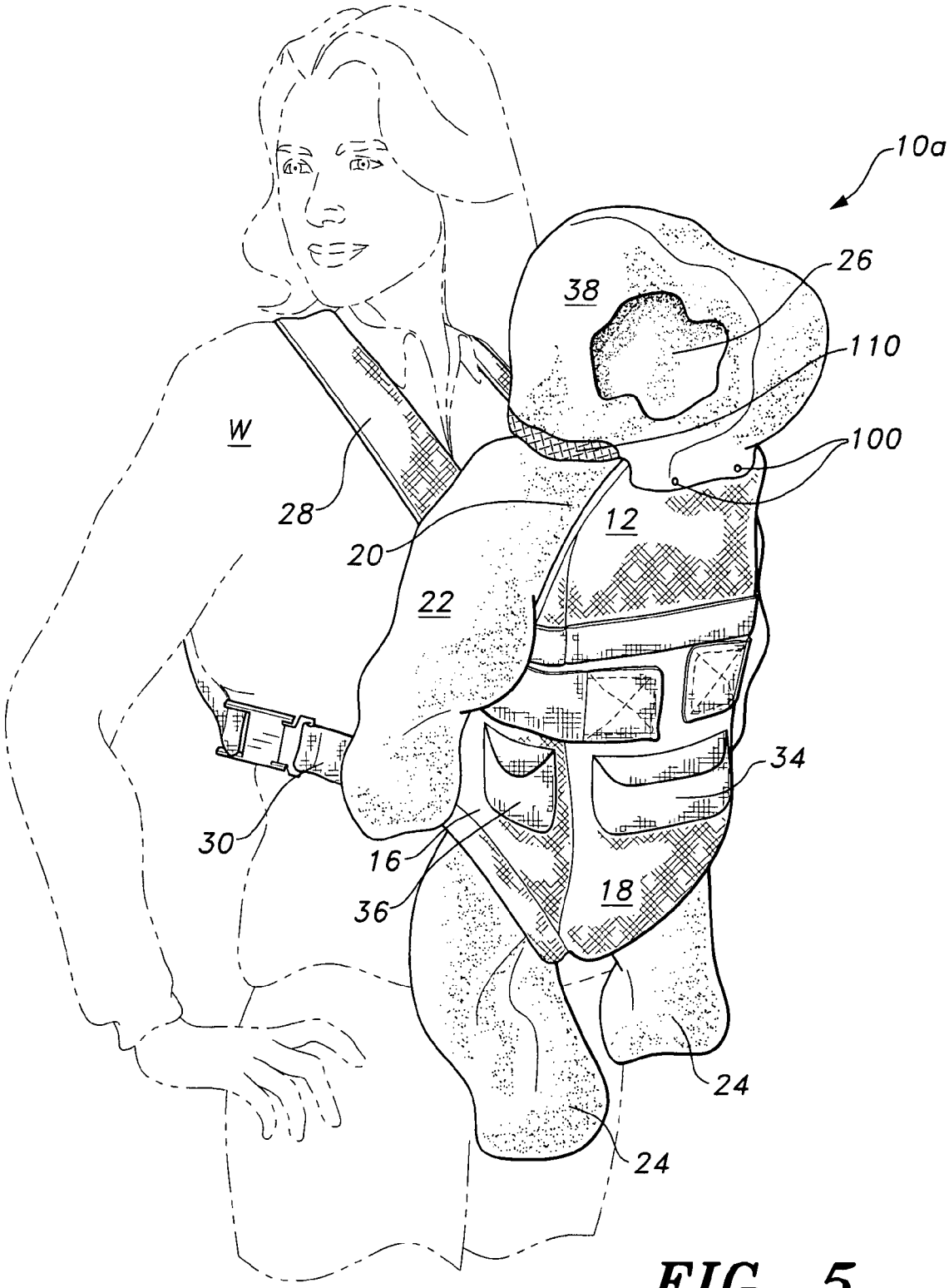
FIG. 5 is an environmental, perspective view of an alternate embodiment of a combination snowsuit and carrier for baby/infant according to the present invention.

FIG. 5 shows an alternate embodiment of combination snowsuit and carrier 10*a*, which further includes a head blanket 38. Head blanket 38 is attached to an upper portion of back support 12 by releasable fasteners, such as snaps 100, buttons, or the like, and is designed to be draped over the top of the head of the infant to cover the infant's face. Head blanket 38 provides further protection from the elements by protecting the infant's face from exposure to wind. Preferably, a strip of mesh or fishnet-type cloth 110 is formed along the lower edge of blanket 38, as shown in FIG. 5, allowing for proper ventilation and air transmission for the infant.

It is to be understood that the present invention is not limited to the embodiments described above, but encompasses any and all embodiments within the scope of the following claims.

I claim:

1. A combination snowsuit and carrier for infants, comprising:

a body support structure configured to support the body of the infant, the body support structure having a front support, a back support, a pair of side supports, and a seat support for supporting the bottom of the infant, the seat support having a pair of openings formed therethrough for removably receiving the legs of the infant;

a one-piece coverall garment configured to removably receive the body of the infant, the one-piece coverall garment having a main body portion, a pair of arm sleeves, a pair of legs, and a hood, the coverall garment forming a snowsuit, the main body portion being integrally formed with the body support structure, wherein said main body portion includes a releasable closure element for allowing the infant to be placed in the garment; and a harness adapted to be worn by a wearer, the harness being joined to the body support structure, the harness including a waist belt and a pair of shoulder straps wherein the front support of said body support structure is attached to the main body portion of said coverall garment, and said releasable closure element comprises a single releasable closure element attached to both the main body portion of said coverall garment and to the front support of the body support structure for opening both the front support and the main body portion for placing an infant in the combination snowsuit and carrier.

2. The combination snowsuit and carrier for infants as recited in claim 1, wherein the shoulder straps have first ends attached to the body support structure and second ends joined together, the joined second ends being adapted for positioning behind the wearer's shoulders.

3. The combination snowsuit and carrier according to claim 2, wherein said waist belt comprises first portions attached to said body support structure, second portions extending from the joined second ends of said shoulder straps, and buckles for releasably connecting the first and second portions on opposite sides of the wearer's waist.

4. The combination snowsuit and carrier according to claim 3, wherein said buckles include means for adjusting length of said waist belt.

5. The combination snowsuit and carrier as recited in claim 1, further comprising a head-mounted blanket releasably attached to the back support of said body support structure, the blanket being adapted for folding over a head of an infant placed in the snowsuit to cover the infant's face.

6. The combination snowsuit and carrier according to claim 5, further comprising snap fasteners attached to the back support and to said blanket, the snap fasteners mating to releasably attach the blanket to the combination snowsuit and carrier.

7. The combination snowsuit and carrier according to claim 1, wherein said releasable closure element comprises a zipper.

8. The combination snowsuit and carrier as recited in claim 1, further comprising at least one pocket formed on an exterior surface of the body support structure.

9. The combination snowsuit and carrier according to claim 8, wherein said at least one pocket comprises a first pocket and a second pocket, the first and second pockets being disposed on opposite sides of said body support structure, respectively, the first and second pockets being adapted for containing infant care accessories.

* * * * *